US007585259B2

(12) United States Patent
Turner

(10) Patent No.: US 7,585,259 B2
(45) Date of Patent: Sep. 8, 2009

(54) WEIGHTLIFTING SPOTTING MACHINE

(75) Inventor: Joseph Scott Turner, San Antonio, TX (US)

(73) Assignee: Maxrep Benchcrafters LLC, San Antonio, TX (US)

( * ) Notice: Subject to any disclaimer, the term of this patent is extended or adjusted under 35 U.S.C. 154(b) by 304 days.

(21) Appl. No.: 11/337,718

(22) Filed: Jan. 23, 2006

(65) Prior Publication Data

US 2006/0194678 A1 Aug. 31, 2006

Related U.S. Application Data

(60) Provisional application No. 60/646,166, filed on Jan. 24, 2005, provisional application No. 60/710,872, filed on Aug. 25, 2005.

(51) Int. Cl.
*A63B 21/078* (2006.01)

(52) U.S. Cl. ..... 482/104

(58) Field of Classification Search ..... 482/92–94, 482/97–104, 106–108, 142, 1, 4–7; 211/60.1
See application file for complete search history.

(56) References Cited

U.S. PATENT DOCUMENTS

| | | | | |
|---|---|---|---|---|
| 3,235,255 | A | 2/1966 | Leflar | |
| 3,874,658 | A | 4/1975 | Flowers | |
| 4,249,726 | A | 2/1981 | Faust | |
| 4,253,662 | A | 3/1981 | Podolak | |
| 4,324,398 | A | 4/1982 | Hole | |
| 4,411,425 | A | 10/1983 | Milnar | |
| 4,561,651 | A | 12/1985 | Hole | |
| 4,635,930 | A | 1/1987 | Cormier | |
| 4,799,672 | A * | 1/1989 | Barrett | 482/104 |
| 4,807,875 | A * | 2/1989 | Tanski | 482/104 |
| 4,998,723 | A | 3/1991 | Santoro | |
| 5,050,868 | A | 9/1991 | Pearson | |
| 5,151,072 | A | 9/1992 | Cone et al. | |
| 5,273,506 | A | 12/1993 | Dawson, Jr. | |
| 5,314,394 | A * | 5/1994 | Ronan | 482/104 |
| 5,468,203 | A * | 11/1995 | Okonkwo | 482/104 |
| 6,264,586 | B1 * | 7/2001 | Webber | 482/104 |
| 6,623,409 | B1 * | 9/2003 | Abelbeck | 482/104 |
| 6,689,027 | B1 | 2/2004 | Gardikis, Jr. | |
| 6,746,379 | B1 | 6/2004 | Brawner | |
| 6,926,649 | B2 * | 8/2005 | Slawinski | 482/104 |
| 7,374,515 | B2 * | 5/2008 | Slawinski | 482/104 |
| 7,455,629 | B2 * | 11/2008 | Abelbeck | 482/92 |
| 2005/0277524 | A1 * | 12/2005 | Bae | 482/93 |
| 2006/0252609 | A1 * | 11/2006 | Abelbeck | 482/92 |
| 2007/0179030 | A1 * | 8/2007 | Slawinski | 482/98 |

* cited by examiner

*Primary Examiner*—Loan H Thanh
*Assistant Examiner*—Oren Ginsberg
(74) *Attorney, Agent, or Firm*—Kammer Browning PLLC

(57) ABSTRACT

A weightlifting apparatus that supports a free weight barbell when activated using two counter-weight controlled support arms that are mechanically attached to a vertical support on a bench press system. The vertical supports each have a slide rail that is mechanically coupled to a locking assembly that acts to release the support arms using buttons. The support arms are attached to independent counterweights or springs by means of a cable. When released by a foot pedal these support arms are elevated by the counterweights. The support arms hold the barbell and prevent it from downward movement via the one-way locking assembly mounted to the support arms. The support arms work independently of one another so that a user may reset each support arm independently.

8 Claims, 6 Drawing Sheets

WEIGHTLIFTING SPOTTING MACHINE

CROSS REFERENCE TO RELATED APPLICATIONS

This U.S. non-provisional application claims the benefit of U.S. provisional Patent Application, Ser. No. 60/646,166, entitled "Weightlifting Spotting Machine," filed on Jan. 24, 2005, having at least one co-inventor in common with this application, which provisional Patent Application is herein incorporated by reference. This U.S. non-provisional application claims the benefit of U.S. provisional Patent Application Ser. No. 60/710,872, entitled "Weightlifting Spotting Machine with Springs," filed on Aug. 25, 2005, having at least one co-inventor in common with this application, which provisional Patent Application is herein incorporated by reference.

BACKGROUND

The invention relates generally to free weight exercise equipment, and more particularly to an improved self-spotting bench press system.

The use the barbells for conditioning and enhancement of the body's muscular tone is widely practiced by a variety of people. Most common weight training is executed with a spotter, that is, someone who can assist the lifter when they become fatigued, are having difficulty, or are about to drop the weight. Style, communication, consistency and reaction time are all factors that vary depending on the spotter being used at any given time. Bench pressing, however, without a spotter can be dangerous. Without someone to grab the barbell and prevent the barbell from dropping on the weightlifter there is a significant danger of serious injury due to fatigue or improper technique. This danger exists in a wide variety of situations, from private to professional weightlifting.

U.S. Pat. No. 4,249,726 is directed to a safety device for use in conjunction with bench press exercise equipment, wherein a pair of arms controllable by the exerciser may be elevated into engagement with a barbell to raise it clear of the exerciser before the barbell can seriously injuring him should he be unable, due to fatigue, to raise the barbell to its normal support panel off the bench. The elevating mechanism may be a power operated jack or counterweights normally controlled by a jack. This invention enables the user by activation of an electric switch to raise and lower the structure which acts as a safety support for the barbells. A pair of limit switches may be engaged by an adjustable stop assembly to stop the arm once a predetermined elevation is reached. The adjustable stop assembly also acts as a ratchet to prevent inadvertent lowering of the arms.

U.S. Pat. No. 5,150,072 is directed to a free weightlifting apparatus adapted for return of a free-weight barbell to a stationary barbell support rack without other ancillary assistance for a lone exerciser participating in a variety of free weightlifting exercises. The frame is raised and lowered by a hydraulic cylinder which is powered by an electrically driven pump. Electrical switches on the support rack are activated when the free-weight barbell depresses the sleeves, and the electrical switches are deactivated when the barbell automatically rolls off the sleeve and repositions itself on the support rack.

U.S. Pat. No. 5,273,506 is directed to a weightlifting station including a pair of guideposts for guiding a barbell assembly in a vertical direction. The barbell assembly includes a weight bar, a sleeve telescoped over the weight bar and stops attached to the sleeve with catch pins to restrain the stops in any one of three conditions of orientation. In one condition, the catch pins lock the stops in engagement with apertures in the posts, thereby preventing vertical movement of the bar from a selected vertical position. In another condition, the catch pins lock the stops in a position disengaged and remote from the apertures permitting the barbell assembly to slide vertically on the guide posts. In the third condition, a user may manually rotate the sleeve, throughout a small range limited by the catch pins from a position where the stops are fully engaged with the apertures, to a position where the stops are withdrawn from the apertures, thereby providing the user with a self stopping capability. In this invention there is no mechanism to pull up a support rack automatically to a fixed position to hold the barbells.

U.S. Pat. No. 6,746,379 is directed to a self stopping safety bench press comprising an adjustable bench and up-rights located on either side of the bench adjacent the lifters upper body. Lifting arms extend from the uprights into the barbells pathway and have the ability to slide up and down to contact the barbell and decrease the weight exerted on the exerciser. Hydraulic cylinders provide force to each lifting arm, which is depressed below the barbells path before use. When assistance is needed, the exerciser releases a hydraulic restrictor valve causing the arms to ascend removing a user determined amount of weight from the barbell while permitting the user to continue performing repetitions. A second restrictor valve can allow only upward movement should the exerciser fail. A third flow restrictor valve adjusts the rate of arm travel. An air charged hydraulic accumulator provides the hydraulic pressure to the cylinders. This invention provides no mechanism to lock the lifting arm in a position to hold the barbells in a predetermined fixed position.

U.S. Pat. No. 6,689,027 is directed to an automatic spotting weight machine used to support a weight bar and create an escape opening after a failed bench press lift. In one of the embodiments, a foot release mechanism and mechanical knuckle work in conjunction to drop the head end of the weight bench so that the weights are resting on a pair of support bars. In one embodiment, there is a disclosed means of controlling the drop of the bench portion of the weight machine so that it is lowered gently.

It would therefore be desirable for an self-spotting safety bench press that assists in lifting barbells and automatically hold them in place without user assistance and without the use of electrical or hydraulic motor means.

BRIEF DESCRIPTION

Briefly, in accordance with one embodiment of the present invention, a self-spotting bench press for safely supporting a barbell above a weightlifting bench having a pair of vertical supports with a slide rail that is coupled to the respective vertical support and a pair of support arms. Each of the support arms is mechanically coupled to each of the vertical supports and to the slide rail and move independently of each other. A locking mechanism is integrally attached to the each of the support arms. The locking mechanism has a locking arm that engages with the slide rail to prevent vertical downward movement of the support arm when the locking arm is in the locked position and to enable vertical movement when the locking arm is in the unlocked position. Each support arm is also lockingly engaged with a foot switch that when activated acts to release a foot pedal locking arm to allow vertical movement along the slide rail, using force provided by counter-weights or spring tension.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

The present invention is a self spotting safety bench press with a pair of support arm's that may be elevated and locked into engagement with barbells so the barbells can be rested on the support arm before the barbells seriously injuring a user should the user be unable to raise the barbell during a normal exercise routine. The support arms are independently lifted by a pair of counter-weights and held in place by mechanical locking devices that allow only for upward movement of the barbell and support arms while in the locked position. The counterweights are used to lift the support arms. While the support arms hold the barbell, the exerciser can push upward on the barbell and the support arms will continue to move vertically upward and lock into the next position available on the vertical support and thus prevent the support arms from moving downward. After the user regains control by lifting the barbells using the support arms, the barbells can be put on barbell rests before the locking mechanism can be reset to its original position. Resetting the locking mechanism and returning the support arms to the original position does not require removal of the weight plates on the barbell to return the barbell to the barbell rests at the top of the vertical support. In this Specification the term barbells may comprise a barbell rod and free weights physically attached to and in locking engagement with the barbells, and a bench press may comprise an adjustable decline/incline military bench press.

Figure 1:
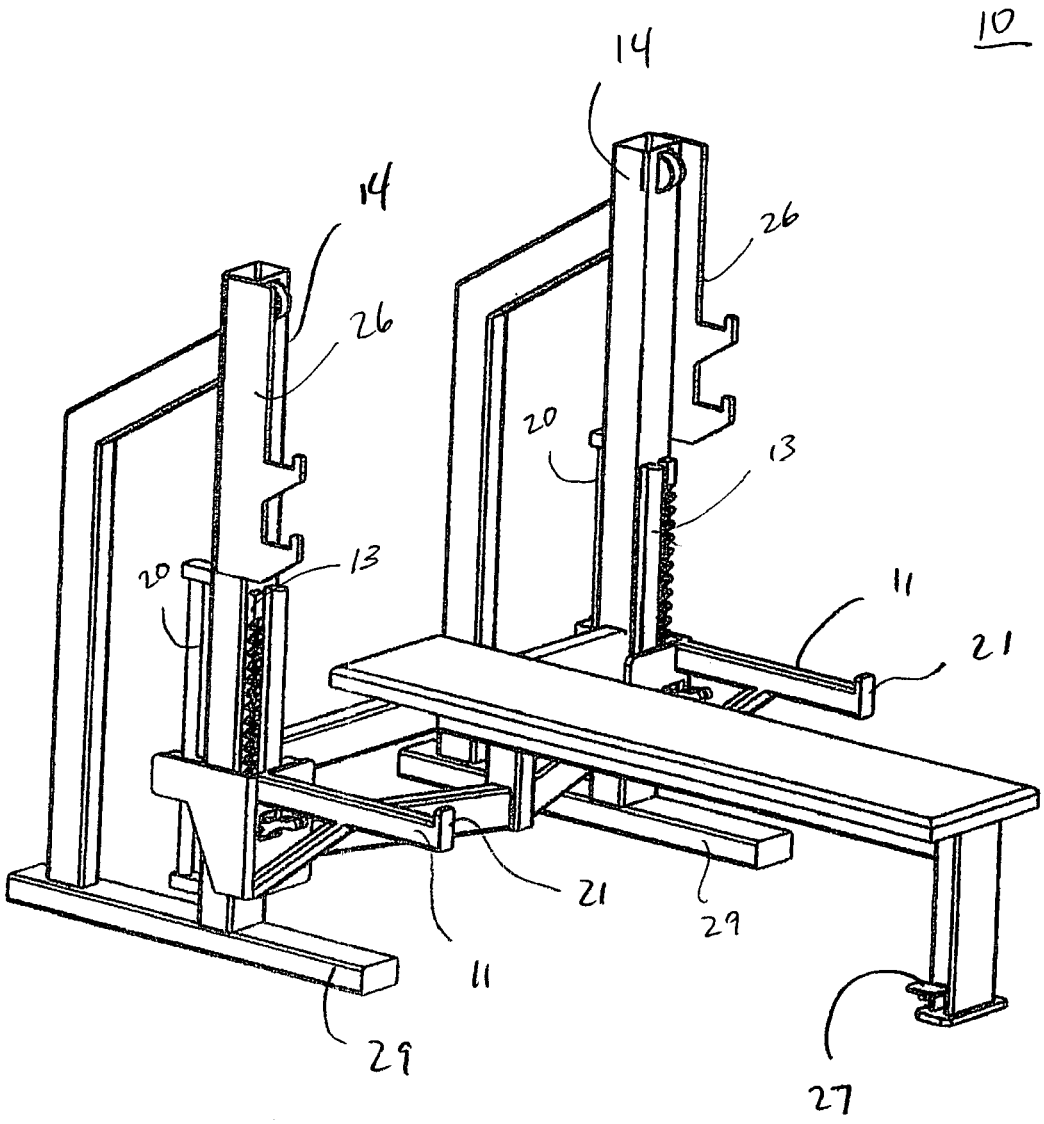
FIG. 1 is a perspective view of the self-spotting bench press system of the present invention.

FIG. 1 illustrates a perspective view of the present invention. The self spotting safety bench press machine comprises a pair of vertical supports 14 having a hollow center, barbell rests 26, slide rails with notches 13, and support slide rails 20. Barbell rests 26 are fixedly attached to vertical support 14 along an inside surface so as to enable support arm 11 to be movable along vertical support 14. This invention also comprises a foot pedal 27. The support arms 11 are vertically movable along support slide rails 20. The support arm 11 has at an end barbells stops 21 which will prevent the barbell from falling off the end of support arm 11. Foot pedal 27 is operable by a user to unlock support arm 11 such that support arm 11 is movable along vertical support 14 by a counter weight system illustrated further in FIG. 2.

Figure 2:
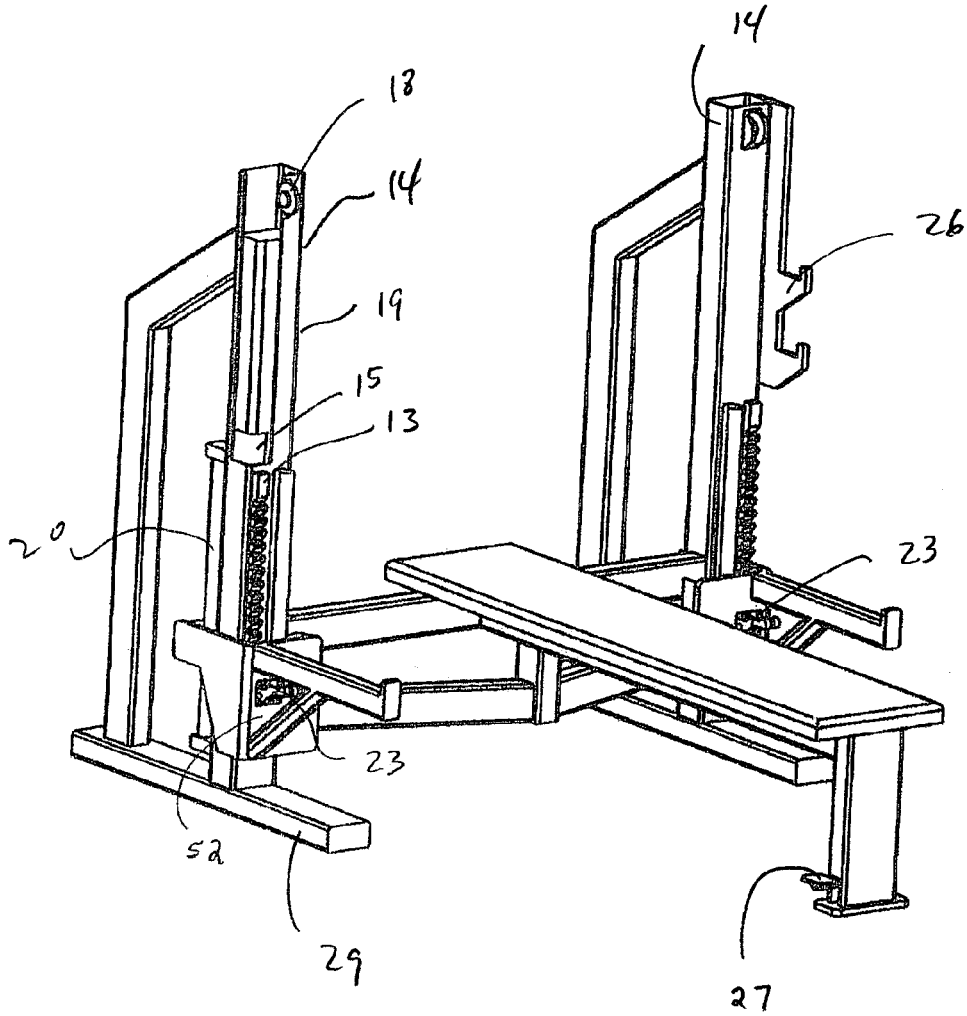
FIG. 2 is a side cutaway view of the vertical support and corresponding counter weight assembly of the present invention.

FIG. 2 illustrates a cut-out view of a counter weight assembly and bearing support system of the vertical support 14. The counter weight assembly comprises a counter weight 15, a cable 19, and a pulley 18. The cables attach at one end to the counter weight 15 and at the other end to the support arm 11. The counter weight is in a range from about 15 to about 100 pounds. Although a counter weight range of about 15 to 100 pounds has been selected in this embodiment any weight may be selected that will automatically raise support arm 11 so as to contact the barbells and lock in place when the foot pedal switch 27 is activated. When a locking mechanism 23 (further described in FIG. 5) is unlocked the counter weight 15 acts to pull up the support arm 11 along the vertical support 14. Locking mechanism 23 is fixedly attached to support arm 11 and is further described in FIG. 5. Support base 29 is fixedly attached to support slide rail 20, vertical support 14, and notched slide rail 13 to provide support for these elements of the present invention. It is within the scope of this invention for cable 19 to be a belt, which may also be expandable and compressible, or a chain, or a cord.

Figure 3:
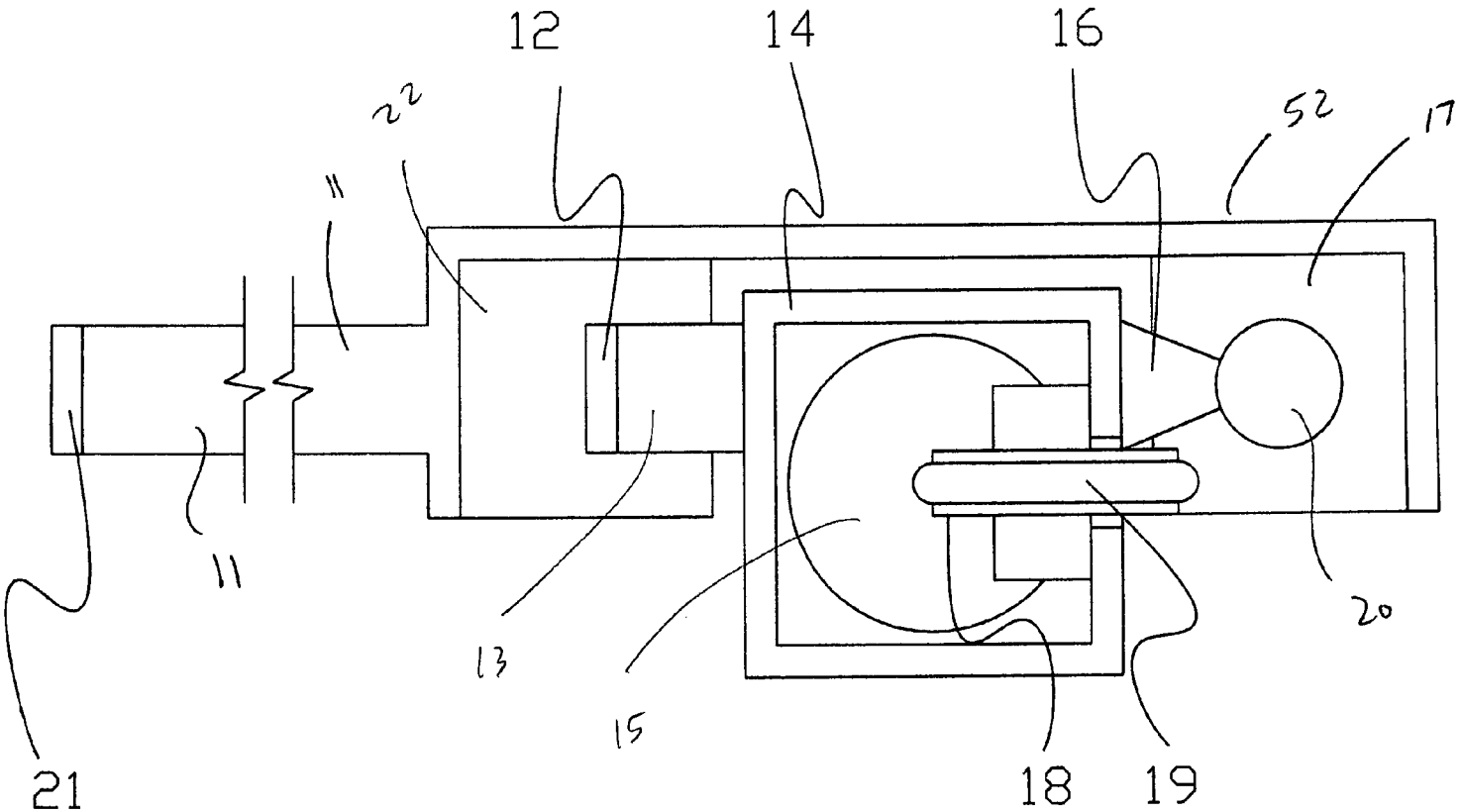
FIG. 3 is a top cutaway view of the support arm assembly and counter weight assembly of the present invention.

FIG. 3 is a top cut-away view of the support arm assembly and counter weight assembly of the present invention. A pulley 18 its fixedly attached at the upper end and disposed inside vertical support 14. A cable 19 is movably attached to pulley 18 and is fixedly attached a counterweight 15 at one end. Counter weight 15 is disposed inside vertical support 14 and movable within vertical support 14. Flat bearing 12 is movably coupled to notched slide rail 13 along the front surface, but not along the surface having notches. Linear bearing 17 its fixedly attached to a support arm 11. Upper bearing and locking mechanical support 22 is fixedly coupled to support arm 11 and provides rigidity to support arm 11. Upper bearing and locking mechanical support 22 is engagingly attached to notched slide rail 13. Barbell stop 21 is fixedly attached to the front end of support arm 11 and acts to prevent barbells and falling off support arm 11. A side surface 52 of support arm 11 is disposed around linear bearing 17, support slide rail 20, vertical support 14, notched slide rail 13 and upper bearing and locking mechanism support 22 to conceal these elements from view. Slide rail support 16 is fixedly attached to a back surface of vertical support 14 so that support arm 11 is movable along vertical support 14. Slide rail support 16 is fixedly attached to support base 29 to provide rigidity and support to vertical support 14. A linear bearing 17 is moveably attached to support slide rail 20 and acts to move up and down support slide rail 20.

Figure 4:
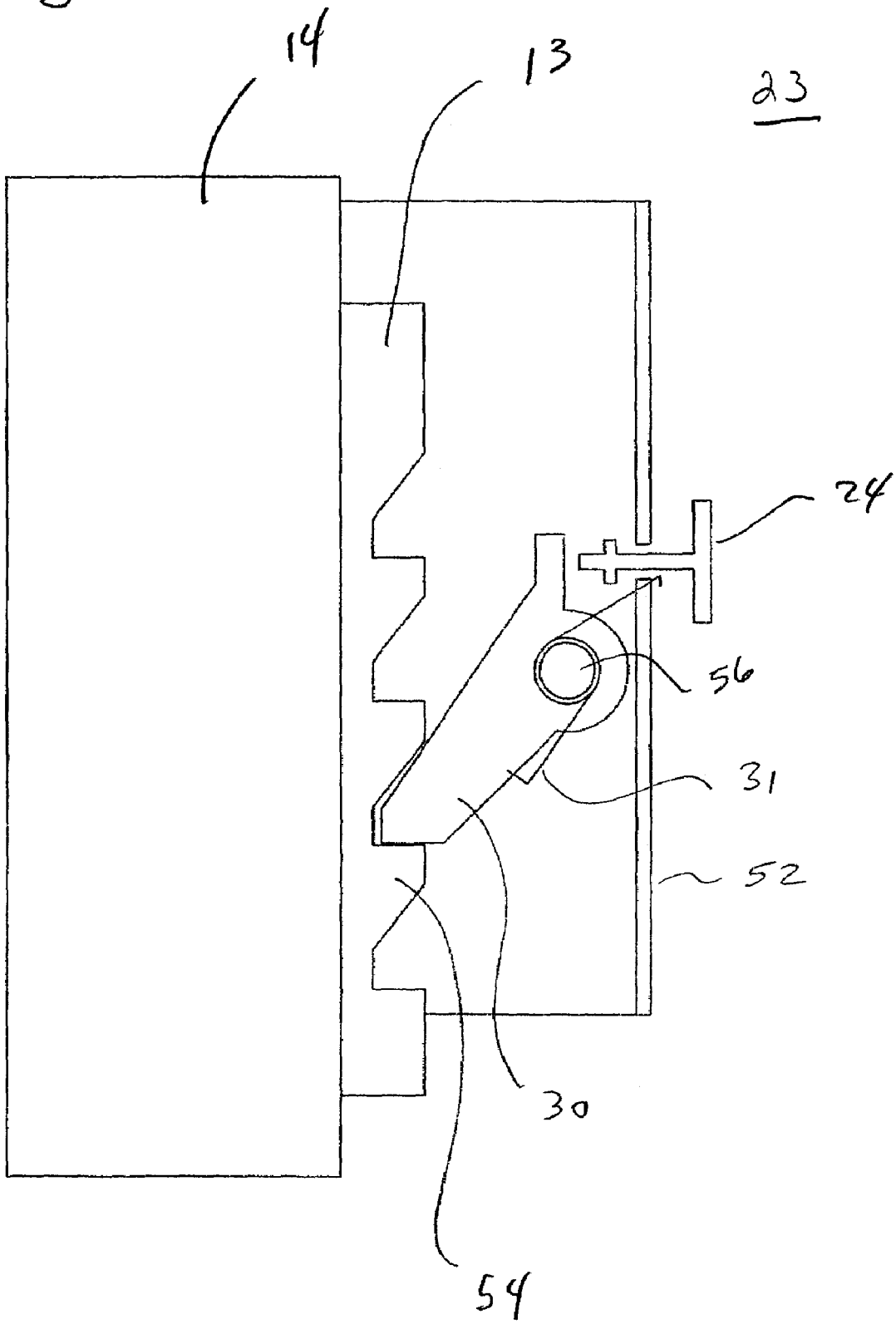
FIG. 4 is a side view of the locking support mechanism of the present invention.

FIG. 4 illustrates locking mechanism 23. Locking mechanism 23 comprises notched slide rail 13 having a plurality of teeth 54 along a side surface, each notch in approximately 1 inch from the adjacent notch and may be shaped having a flat surface at an upper end a ramp surface at the lower end. The saw-tooth shape of the notches enable locking arm 30 to engage and lock in place when a support arm 11 moves in a downward direction and to ratchet against the saw-tooth shaped notches when support arm 11 moves in an upward direction. It is within the scope of the present invention for slide rail 13 to have teeth with any shape that enables locking arms to engage slide rail 13 to lock when locking mechanism moves downward but not lock when locking mechanism moves upwards. Locking arm 30 is pivotal about pivot 56 so as to engage and disengage teeth 54. A locking arm spring 31 maintains tension between surface 52 and locking arm 30 acts so as to maintain contact between the locking arm 30 and teeth 54 of notched slide rail 13 in the absence of force from on locking buttons 24. Locking button 24 act on locking arm 30 to set it in the unlock position when locking button 24 is depressed thus enabling support arm 11 to move in a vertical upward and downward direction. When the button 24 is set to the locking position, support arm 11 may only be moved vertically upward along vertical support 14 and is adapted to be locked by each notch of slide rail 13 as vertical support arm 11 moves downward.

Figure 5:
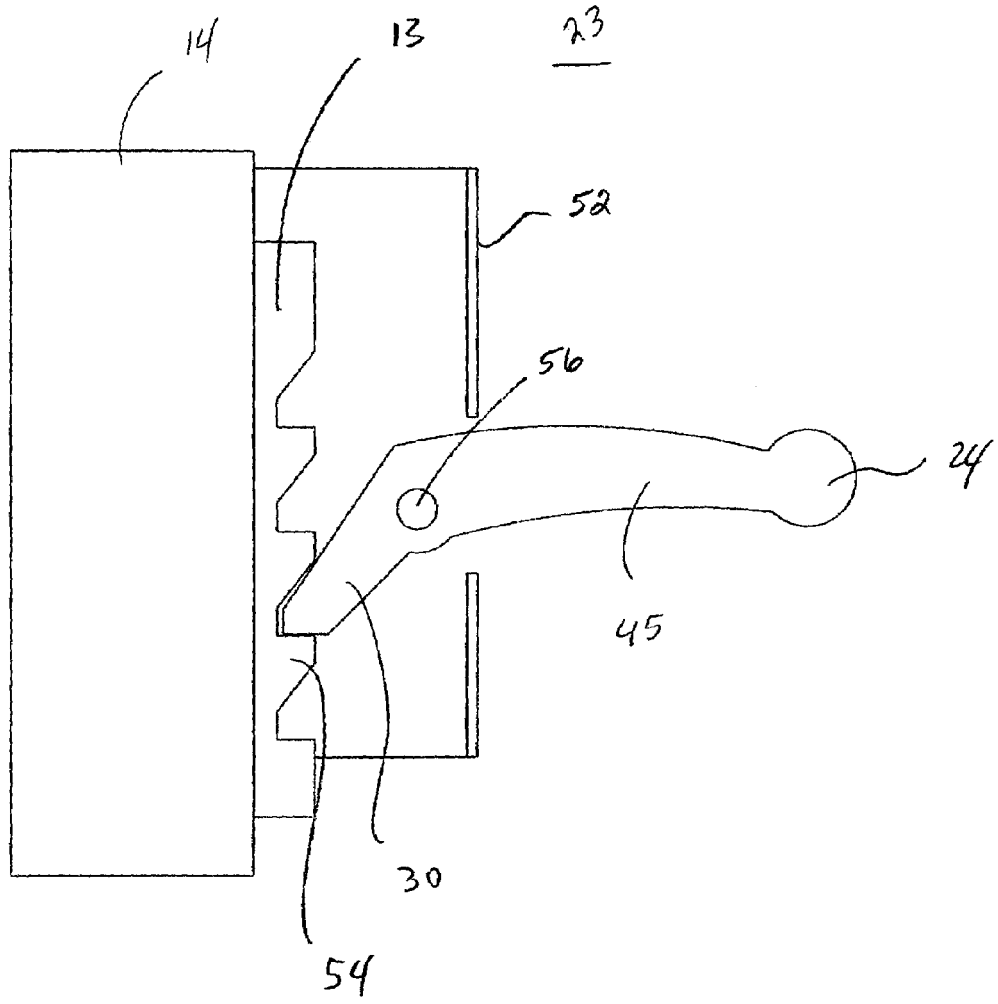
FIG. 5 is an alternative embodiment of the locking mechanism of the present invention that uses a weight instead of a locking arm spring.

FIG. 5 illustrates an alternative embodiment of locking mechanism 23. In this exemplary embodiment locking arm 30 is coupled to a weight 45 instead of a locking arm spring 31. The gravitational force of weight 45 acts on locking arm 30 through pivot 56 to secure it against slide rail 13 so that the saw-tooth shape of the notches enable locking arm 30 to engage and lock in place when a support arm 11 moves in a downward direction and to ratchet against the saw-tooth shaped notches when support arm 11 moves in an upward direction. Slide rail 13 is secured to vertical support 14. Weight 45 may for example be in a range from about 0.2 to about 1 pounds. Locking button 24 act on locking arm 30 to set it in the unlock position when locking button 24 is held in the unlock (that is the upward position), thus enabling support arm 11 to move in a vertical upward and downward direction. When button 24 is released to the locking position, (that is in the downward position) support arm 11 may only be moved vertically upward along vertical support 14 and is adapted to be locked by each notch of slide rail 13 as vertical support arm 11 moves downward.

In a further exemplary embodiment of the present invention notched slide rails 13 may not have notches but be relatively smooth. In this instance locking arms 30 enter into locking engagement with slide rail 13 by force created by locking arm weight 45 and the force generated by the weight of the locking support mechanism 23.

Figure 6:
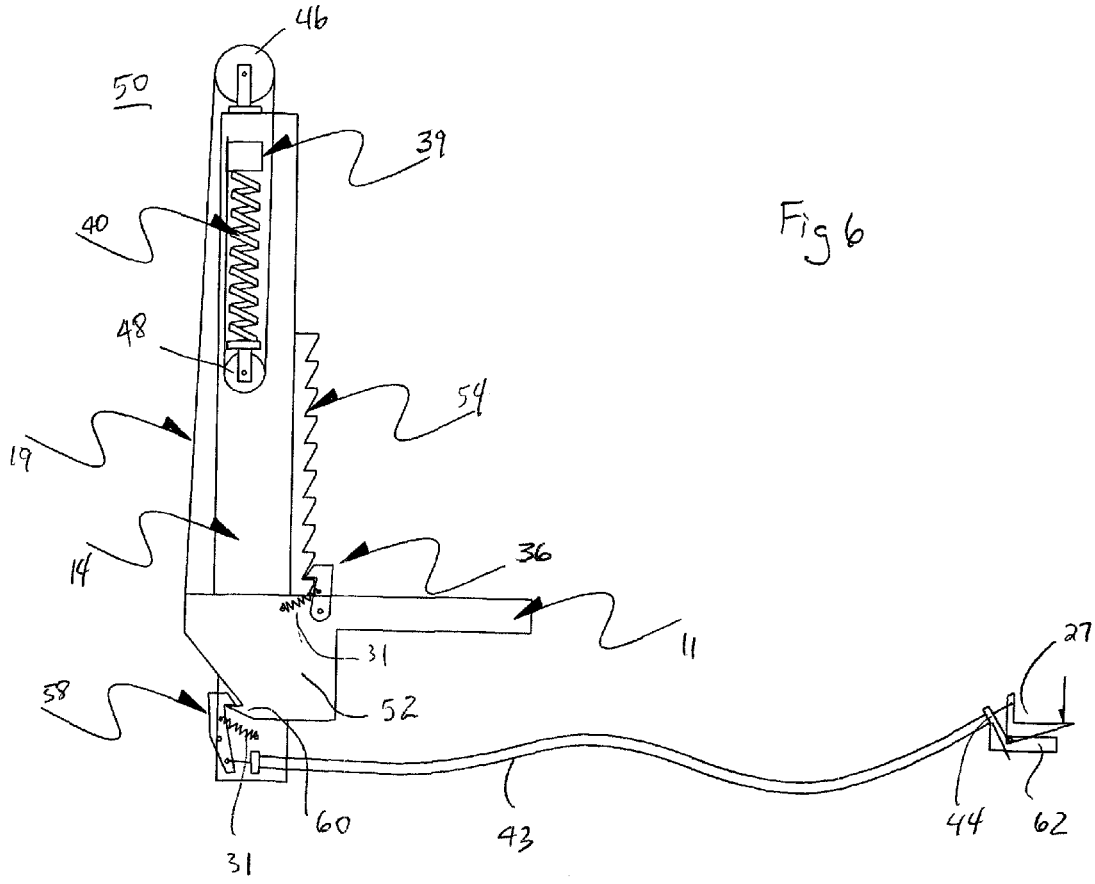
FIG. 6 is a embodiment of the counter-weight assembly consisting of a single-line diagram of a spring loaded assembly and locking support mechanism of the present invention.

FIG. 6 illustrates a single-line diagram of the operation of the present invention. A spring 40 is physically disposed inside vertical support 14 and fixedly coupled to spring mount 39. Spring mount 39 is fixedly coupled to vertical support 14 at an upper end and disposed within vertical support 14. Spring 40 is physically coupled to a lower spring pulley 48 at the bottom of spring 40 and upper spring pulley 46 is fixedly coupled to the top of vertical support 14. A cable 19 is physically attached to spring mount 39 on vertical support 14, is moveably attached to lower spring pulley 48 and upper spring pulley 46 and attached to support arm 11. When support arm 11 is move to a reset position spring 40 coils to provide tension force of about 15 pounds and up to about 100 pounds. A foot pedal locking arm 58 is adapted to be in locking engagement with an arm support notch 60. Support notch 60 is fixedly coupled to support arm 11, thus in the reset position foot pedal locking arm 58 holds support arm 11 in the reset position. The locking arm spring 31 holds foot pedal locking arm 58 in the locked position. A foot pedal cable 43 is physically coupled to foot pedal locking arm 58 and a foot pedal 27. Foot pedal 27 is pivotally attached to foot pedal plate 62 and acts to extend cable 43 so as to unlock foot pedal locking arm 58 when foot pedal 27 abuts against a foot pedal cable stop 44. Locking mechanism 23 is said to be in an unlock position when foot pedal 27 is depressed to foot pedal stop 44. Although a tension force range of about 15 to 100 pounds has been selected in this embodiment any force may be selected that will automatically raise support arm 11 so as to contact the barbells and lock in place when the foot pedal switch 27 is activated.

To operate the self spotting safety bench press 10 of the present invention, a user can place a barbell on the barbell rests 26 and began lifting the barbells up-and-down the normal manner after the support arms are set to the reset position. If the user is unable to return the barbell to the barbell rests the user may depress the foot pedal 27 and unlock the foot pedal locking arm 58. The release will allow counterweights 15 to drop down thus causing the support arms 11 to rise as the counter weight 15 pulls the support arm 11 upwardly to make contact with the barbell. Once contact is made by the support arm 11 with the barbell, the user can let go of the barbell and get out from under the weight. To raise the barbell to the barbell rests 26 the weightlifter may raise one side of the barbell up at a time and the locking mechanism 23 of the support arm 11 will prevent the barbell from falling back down. After raising the bar high enough using the support arms 11 and locking mechanism 23, the weightlifter can lift the barbell one side at a time back onto the barbell rests 26. Pushing the locking mechanisms buttons 24 and holding in the locking buttons 24 in the unlatch position on support arm 11 and pushing the support arm 11 back down to the lower end of the vertical support 14, they can resent the support arm 11 on one side. The user can repeat this procedure to raise the other side of the barbell to the barbell rests 26. Thus the support arms 11 can be locked in place by releasing buttons 24 after support arms 11 have been moved to the reset position. This action makes the self spotting bench press of the present invention and ready for the next exercise set.

The previously described embodiments of the present invention have many advantages, including having support arms 11 that are independently lifted by counter-weights 15 and held in place by a mechanical locking assembly 23 that allow only upward movement of the barbell and support arms 11 when the release button 24 is not engaged. The counterweights 15 are not used to lift the weight of the barbell only but to lift the support arms 11. The present invention also does not use an external power source such as an electric or hydraulic motor. It is designed to stop a free-weight barbell from downward movement and support the barbell in place when the locking mechanism 23 is activated. A foot switch 27 activates the locking mechanism 23. While the support arms 11 hold the barbell, the exerciser can push upward on the barbell and the support arms 11 will continue to move upwardly and will lock into the next tooth 54 available on the vertical support 14 and thus prevent the support arms 11 from moving downward. Only upward movement of the barbell is possible once the foot pedal locking arm 58 has been activated and the support arms 11 contact the barbell. The barbells must be put on barbell rests 26 before arm supports 11 can be reset to its original position. Resetting this machine is possible by the user and does not require removal of the weight plates on the barbell to return the barbell to the barbell rests 26.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. An apparatus for assisting with the support of a weight-lifting barbell as a weightlifter individual lifts the barbell from a resting position, the apparatus comprising:

at least one vertical support structure;

at least one support arm extending in a generally rigid orthogonal orientation from the at least one vertical support structure and slidingly engaged thereto, the at least one support arm slidingly positioned on the vertical support structure so as to be positioned below the barbell during use of the apparatus;

means for elevating the at least one support arm in sliding engagement with the vertical support structure from a lowered positioned below and apart from the barbell, to an elevated position below and generally proximate to the barbell, wherein the means for elevating the at least one support arm further comprises a releasable latching mechanism for retaining the at least one support arm in its lowered position until the latching mechanism is released; and means positioned on the at least one support arm for mechanically engaging the vertical support structure and releasably fixing the at least one support arm in its elevated position, wherein the means for releasably fixing the at least one support arm in its elevated position on the at least one vertical support structure comprises a ratcheting assembly allowing the at least one support arm to move to its elevated position but preventing the at least one support arm from returning to its lowered position, the ratcheting assembly comprising a toothed rail fixed on the vertical support structure and a locking arm pivotally fixed on the support arm and biased for engagement with the toothed rail.

2. The apparatus of claim 1 wherein the means for elevating the at least one support arm comprises a spring loaded lifting assembly.

3. The apparatus of claim 1 wherein the means for elevating the at least one support arm comprises a counter-weight loaded lifting assembly.

4. The apparatus of claim 1 wherein the means for elevating the at least one support arm further comprises a foot pedal mechanically linked to the releasable latching mechanism for releasing the at least one support arm from its lowered position.

5. The apparatus of claim 1 wherein the vertical ratcheting mechanism further comprises a ratchet release latch to allow the at least one support arm to return to its lowered position.

6. The apparatus of claim 1 wherein the locking arm pivotally fixed on the support arm is biased for engagement with the toothed rail by a spring.

7. The apparatus of claim 1 wherein the locking arm pivotally fixed on the Support arm is biased for engagement with the toothed rail by a weighted member.

8. An apparatus for assisting with the support of a weightlifiing barbell as a weightlifter individual lifts the barbell from a resting position, the apparatus comprising:

at least one vertical support structure;

at least one support arm extending in a generally rigid orthogonal orientation from the at least one vertical support structure and slidingly engaged thereto, the at least one support arm slidingly positioned on the vertical support structure so as to be positioned below the barbell during use of the apparatus;

means for elevating the at least one support arm in sliding engagement with the vertical support structure from a lowered positioned below and apart from the barbell, to an elevated position below and generally proximate to the barbell, the at least one support arm further comprising a releasable latching mechanism for retaining the at least one support arm in its lowered position until the latching mechanism is released; and means positioned on the at least one support arm for mechanically engaging the vertical support structure and releasably fixing the at least one support arm in its elevated position, the means for releasably fixing the at least one support arm comprising a ratcheting assembly allowing the at least one support arm to move to its elevated position but preventing the at least one support arm from returning to its lowered position, the ratcheting assembly comprising a toothed rail fixed on the vertical support structure and a locking arm pivotally fixed on the support arm and biased for engagement with the toothed rail.

* * * * *